US009982543B2

(12) United States Patent
Spangler

(10) Patent No.: US 9,982,543 B2
(45) Date of Patent: May 29, 2018

(54) PARTIAL CAVITY BAFFLES FOR AIRFOILS IN GAS TURBINE ENGINES

(71) Applicant: United Technologies Corporation, Farmington, CT (US)

(72) Inventor: Brandon W. Spangler, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 309 days.

(21) Appl. No.: 14/818,379

(22) Filed: Aug. 5, 2015

(65) Prior Publication Data

US 2017/0037732 A1 Feb. 9, 2017

(51) Int. Cl.
*F01D 5/18* (2006.01)

(52) U.S. Cl.
CPC ..... *F01D 5/187* (2013.01); *F01D 5/188* (2013.01); *F01D 5/189* (2013.01); *F05D 2220/32* (2013.01); *F05D 2230/60* (2013.01); *F05D 2260/20* (2013.01); *F05D 2260/201* (2013.01)

(58) Field of Classification Search
CPC ..... F01D 5/187; F01D 5/188; F01D 5/189; F05D 2250/185; F05D 2260/20; F05D 2260/201
USPC ..... 416/96 A, 224
See application file for complete search history.

(56) References Cited

U.S. PATENT DOCUMENTS

| | | | | |
|---|---|---|---|---|
| 5,259,730 A * | 11/1993 | Damlis | B23P 15/04 416/96 A |
| 6,435,813 B1 * | 8/2002 | Rieck, Jr. | F01D 5/188 415/115 |
| 8,162,594 B2 * | 4/2012 | Guimbard | F01D 5/189 415/115 |
| 2010/0054915 A1 * | 3/2010 | Devore | F01D 5/189 415/116 |

FOREIGN PATENT DOCUMENTS

| | | |
|---|---|---|
| DE | 19801804 | 7/1999 |
| EP | 1154124 | 11/2001 |
| GB | 976124 | 11/1964 |
| JP | S5847102 | 3/1983 |
| WO | 2015034717 A1 | 3/2015 |

OTHER PUBLICATIONS

European Search Report, European Application No./Patent No. 16172956.1-1610, dated Jan. 5, 2017, European Patent Office; European Search Report 8 pages.

* cited by examiner

*Primary Examiner* — Igor Kershteyn
*Assistant Examiner* — Eric Zamora Alvarez
(74) *Attorney, Agent, or Firm* — Cantor Colburn LLP

(57) ABSTRACT

An airfoil of a gas turbine engine having a hollow body defining at least one airfoil cavity therein, the hollow body defining an inner diameter and an outer diameter and a baffle positioned within the at least one airfoil cavity and extending over less than an entire length between the inner diameter and the outer diameter, the baffle configured to reduce the cross-sectional area within the at least one airfoil cavity. The at least one airfoil cavity includes a first portion having a length that is defined by an open cavity having a full cross-sectional area and a second portion having a length that is defined by a reduced cross-sectional area, the second (Continued)

portion being the length of the baffle within the at least one airfoil cavity.

17 Claims, 8 Drawing Sheets

PARTIAL CAVITY BAFFLES FOR AIRFOILS IN GAS TURBINE ENGINES

STATEMENT REGARDING FEDERALLY SPONSORED RESEARCH OR DEVELOPMENT

This invention was made with government support under Contract No. FA8650-09-D-2923-0021 awarded by the U.S. Air Force. The government has certain rights in the invention.

BACKGROUND

The subject matter disclosed herein generally relates to baffles and, more particularly, to baffles located in cavities of airfoils in gas turbine engines.

In gas turbine engines, cooling air may be configured to flow through an internal cavity of an airfoil to prevent overheating. Gas temperature profiles are usually hotter at the outer diameter than at the inner diameter of the airfoils. In order to utilize cooling flow efficiently and minimize heat pickup and pressure loss, the cross-sectional area of the internal cooling flow may be configured to vary so that Mach numbers remain low where heat transfer is not needed (typically the inner diameter) and high Mach numbers where heat transfer is needed (typically the outer diameter). To do this in a casting, the walls of the airfoils tend to be thick in some areas and thin in other areas, which may add weight to the engine in which the airfoils are employed. Previously, baffles have been used to occupy some of the space within the internal cavity of the airfoils. The baffles extend from one end of the cavity all the way through the other end of the cavity within the airfoil. This configuration may result in relatively high Mach numbers to provide cooling throughout the cavity. Further, such configuration may provide high heat transfer, and pressure loss throughout the cavity.

Thus it is desirable to provide means of controlling the heat transfer and pressure loss in airfoils of gas turbine engines.

SUMMARY

According to one embodiment an airfoil of a gas turbine engine is provided. The airfoil includes a hollow body defining at least one airfoil cavity therein, the hollow body defining an inner diameter and an outer diameter and a baffle positioned within the at least one airfoil cavity and extending over less than an entire length between the inner diameter and the outer diameter, the baffle configured to reduce the cross-sectional area within the at least one airfoil cavity. The at least one airfoil cavity includes a first portion having a length that is defined by an open cavity having a full cross-sectional area and a second portion having a length that is defined by a reduced cross-sectional area, the second portion being the length of the baffle within the at least one airfoil cavity.

In addition to one or more of the features described above, or as an alternative, further embodiments may include at least one standoff in the second portion, the standoff configured to at least one of position the baffle and support the hollow body.

In addition to one or more of the features described above, or as an alternative, further embodiments may include that the baffle extends from a base at one of the inner diameter and the outer diameter to a baffle end that is at a position that is between the inner diameter and the outer diameter, In addition to one or more of the features described above, or as an alternative, further embodiments may include that the baffle comprises a tapered portion extending from a point on the baffle to a baffle end.

In addition to one or more of the features described above, or as an alternative, further embodiments may include that an angle between the tapered portion and a wall of the hollow body is less than 45°.

In addition to one or more of the features described above, or as an alternative, further embodiments may include that an angle between the tapered portion and a wall of the hollow body is between 20° and 35°.

In addition to one or more of the features described above, or as an alternative, further embodiments may include that the baffle has a varying thickness along the length of the second portion.

According to another embodiment, a method of manufacturing an airfoil is provided. The method includes forming a hollow body having at least one airfoil cavity therein, the hollow body extending from an inner diameter to an outer diameter and installing a baffle within the at least one airfoil cavity such that the baffle extends over less than an entire length between the inner diameter and the outer diameter, the baffle configured to reduce the cross-sectional area within the at least one airfoil cavity. The at least one airfoil cavity has a first portion having a length that is defined by an open cavity having a full cross-sectional area and a second portion having a length that is defined by a reduced cross-sectional area, the second portion being the length of the baffle within the at least one airfoil cavity.

In addition to one or more of the features described above, or as an alternative, further embodiments may include installing at least one standoff in the second portion, the standoff configured to at least one of position the baffle during installation and support the hollow body.

In addition to one or more of the features described above, or as an alternative, further embodiments may include that the at least one standoff is integrally formed with the hollow body.

In addition to one or more of the features described above, or as an alternative, further embodiments may include that the baffle extends from a base at one of the inner diameter and the outer diameter to a baffle end that is at a position that is between the inner diameter and the outer diameter, In addition to one or more of the features described above, or as an alternative, further embodiments may include that the baffle comprises a tapered portion extending from a point on the baffle to a baffle end.

In addition to one or more of the features described above, or as an alternative, further embodiments may include that an angle between the tapered portion and a wall of the hollow body is less than 45°.

In addition to one or more of the features described above, or as an alternative, further embodiments may include that an angle between the tapered portion and a wall of the hollow body is between 20° and 35°.

In addition to one or more of the features described above, or as an alternative, further embodiments may include that the baffle has a varying thickness along the length of the second portion.

In addition to one or more of the features described above, or as an alternative, further embodiments may include that installing the baffle comprises integrally forming the baffle with the hollow body.

According to another embodiment, a gas turbine engine is provided. The engine includes an airfoil having a hollow body defining at least one airfoil cavity therein, the hollow body defining an inner diameter and an outer diameter and a baffle positioned within the at least one airfoil cavity and extending over less than an entire length between the inner diameter and the outer diameter, the baffle configured to reduce the cross-sectional area within the at least one airfoil cavity. The at least one airfoil cavity has a first portion that is defined by an open cavity having a full cross-sectional area and a second portion that is defined by a reduced cross-sectional area, the second portion being the length of the baffle within the at least one airfoil cavity.

In addition to one or more of the features described above, or as an alternative, further embodiments may include that the baffle extends from a base at one of the inner diameter and the outer diameter to a baffle end that is at a position that is between the inner diameter and the outer diameter, In addition to one or more of the features described above, or as an alternative, further embodiments may include that the baffle comprises a tapered portion extending from a point on the baffle to the baffle end.

In addition to one or more of the features described above, or as an alternative, further embodiments may include that the baffle has a varying thickness between the base and the baffle end.

Technical effects of embodiments of the present disclosure include baffles configured within airfoils that are configured to extend into only a portion of a cavity of the airfoil. Further technical effects include tapered or wedged baffles that are configured to improve air flow through the cavities. Further technical effects include improved cooling effectiveness within airfoils while maintaining low weight in an engine.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
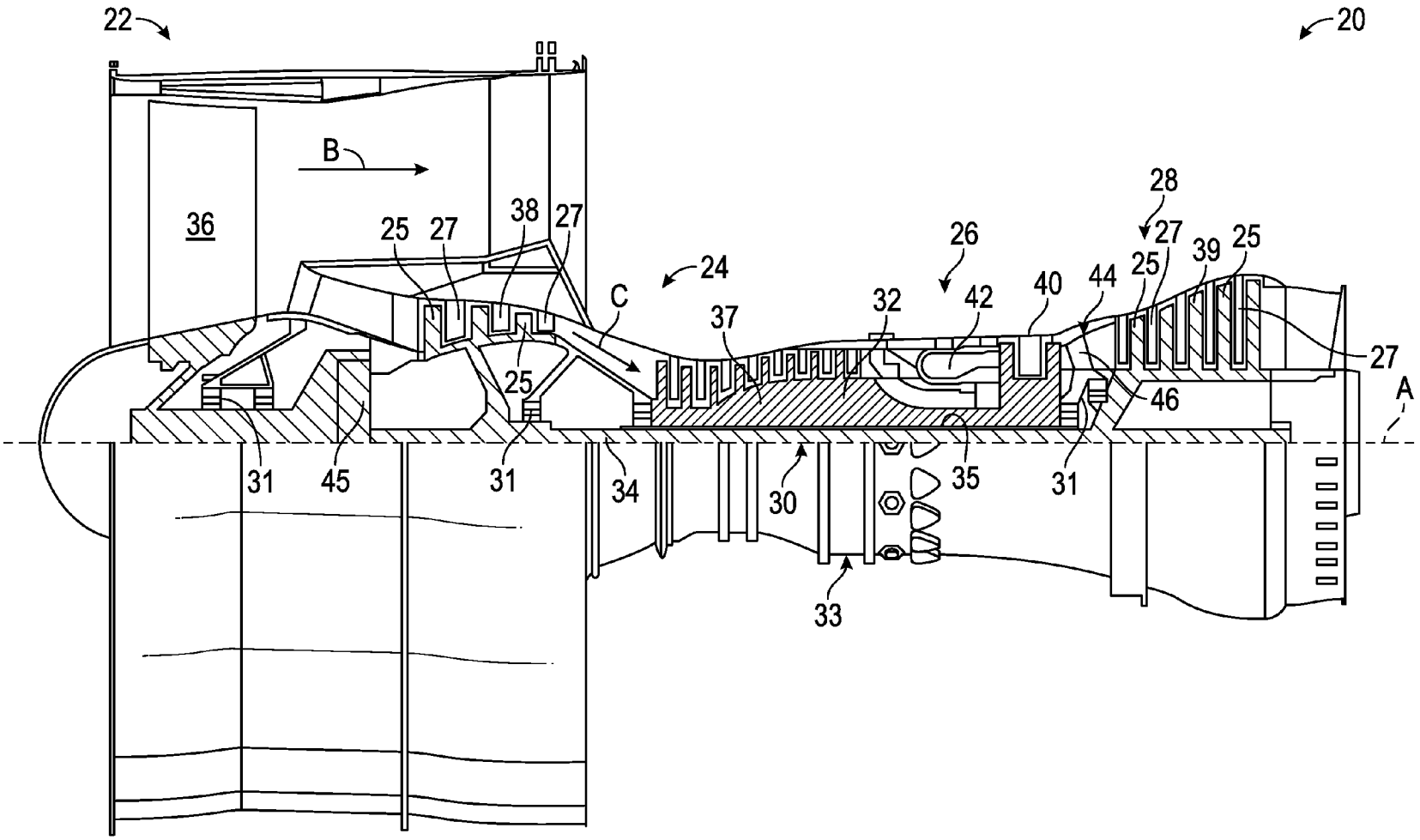
FIG. 1A is a schematic cross-sectional view of a gas turbine engine that may employ various embodiments disclosed herein.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition-typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of [(Tram° R)/(518.7° R)]0.5, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 1B:
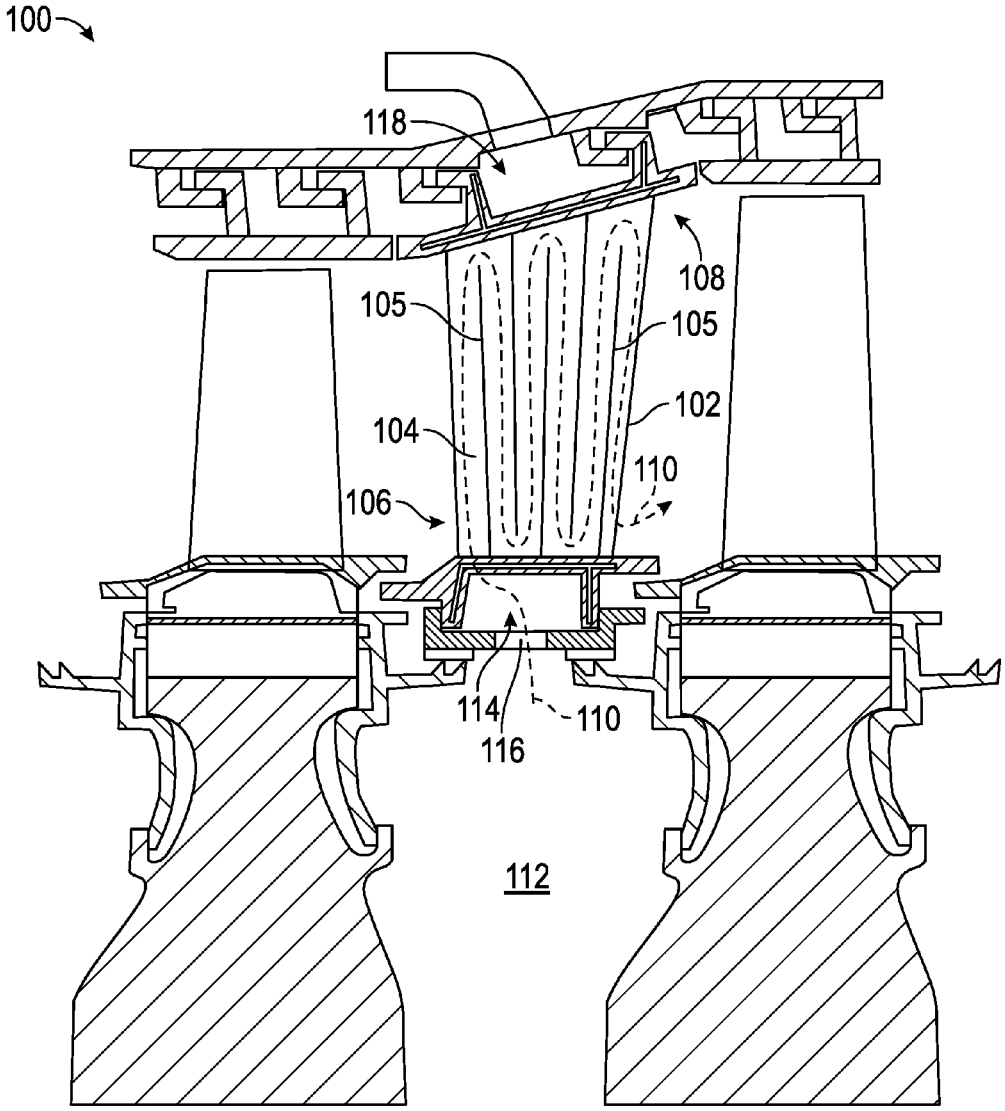
FIG. 1B is a schematic view of a turbine that may employ various embodiments disclosed herein.

FIG. 1B is a schematic view of a turbine that may employ various embodiments disclosed herein. Turbine 100 includes one or more airfoils 102. The airfoil 102 may be a hollow body with an internal cavity defining a number of channels or cavities 104, hereinafter airfoil cavities 104, formed therein and extending from an inner diameter 106 to an outer diameter 108, or vice-versa. The airfoil cavities 104 may be separated by partitions 105 that may extend either from the inner diameter 106 or the outer diameter 108 of the airfoil 102. The partitions may extend for a portion of the length of the airfoil 102, but may stop or end prior to forming a complete wall within the airfoil 102. Thus, each of the airfoil cavities 104 may be fluidly connected.

As shown, counting from a leading edge on the left, the airfoil 102 may include six airfoil cavities 104 within the hollow body: a first airfoil cavity on the far left followed by a second airfoil cavity immediately to the right of the first airfoil cavity and fluidly connected thereto, and so on. Those of skill in the art will appreciate that the partitions 105 that separate and define the airfoil cavities 104 are not usually visible and FIG. 1B is merely presented for illustrative and explanatory purposes.

The airfoil cavities 104 may be configured to have air flow therethrough to cool the airfoil 102. For example, as shown in FIG. 1B, an airflow path 110 is indicated by a dashed line. Air flows from a rotor cavity 112 and into an airfoil inner diameter cavity 114 through an orifice 116. The air then flows into and through the airfoil cavities 104 as indicated by the airflow path 110. Positioned at the outer diameter of the airfoil 102 may be an outer diameter cavity 118.

As noted, air is passed through the airfoil cavities of the airfoil to provide cooling airflow to prevent overheating of the airfoils and/or other components or parts of the turbine. The flow rate through the airfoil cavities may be a relatively low flow rate of air and because of the low flow rate the cooling may be too low to achieve the desired metal temperatures. One solution to this is to add a baffle into the airfoil cavities. Although referred to herein as an airfoil, those of skill in the art will appreciate that the same concepts shown and described herein may be employed for vanes, blades, or other elements that may employ a baffle.

Figure 2B:
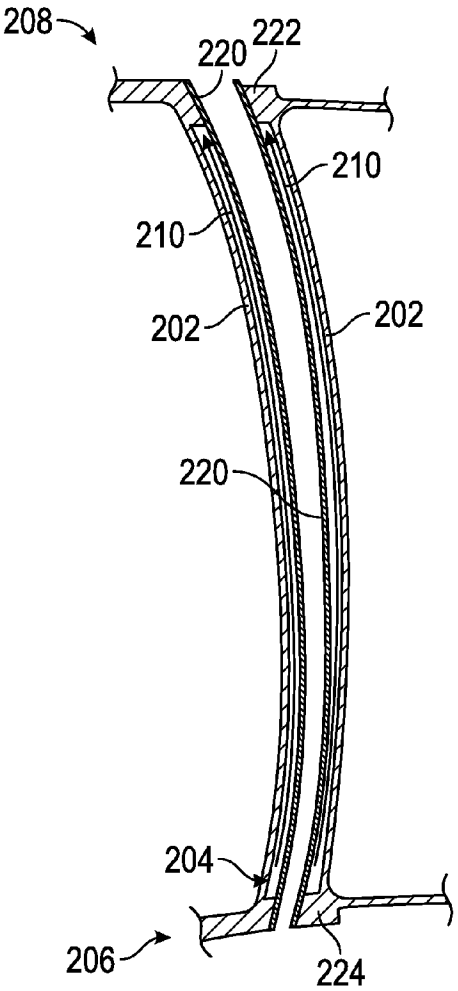
FIG. 2B is a cross-sectional view of the full-baffle configuration along the line B-B of FIG. 2A.
Figure 2A:
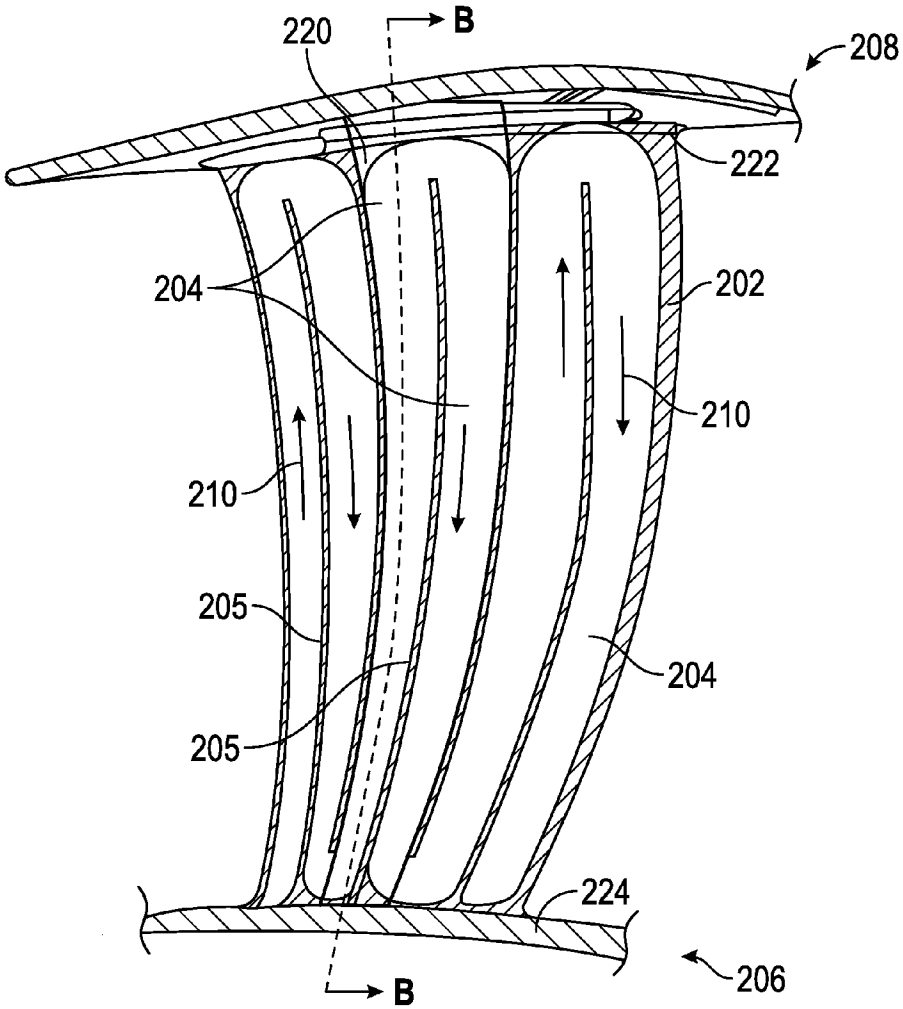
FIG. 2A is an isometric view of a full-baffle configuration.

Turning to FIGS. 2A and 2B, a configuration of an airfoil and internal full-baffle is shown. FIG. 2A shows a perspective view of an airfoil 202 with a full-baffle 220 installed therewith. As will be appreciated by those of skill in the art, FIG. 2A is merely illustrative, and the internal structure of the airfoil 202 is shown for explanatory purposes. FIG. 2B shows a cross-sectional view of the airfoil 202 and baffle 220 as viewed along line B-B in FIG. 2A.

As shown in FIG. 2A, the baffle 220 is positioned in only two of the six airfoil cavities 204 of airfoil 202, e.g., within the two central airfoil cavities 204. The airfoil cavities 204 are separated by partitions 205. However, those of skill in the art will appreciate that the baffle 220 may be configured within more, fewer, or different airfoil cavities 204 of the airfoil 202. That is, in FIG. 2A, the baffle 220 is shown within the third and fourth airfoil cavities, but in some configurations the baffle may only be within one airfoil cavity, other airfoil cavities, or combinations thereof.

In operation, air flows within the internal cavity of the airfoil 202 along airflow path 210, indicated by the arrows in FIGS. 2A and 2B, to provide cooling to the airfoil 202.

As shown in FIG. 2B, the baffle 220 abuts against casting 222 at the outer diameter 208 and abuts against casting 224 at the inner diameter 206. The positioning of the baffle 220 at the inner and outer diameters may be to appropriately position and secure the baffle 220 in place and also to provide a seal at the turn between airfoil cavities 204. As shown, the baffle 220 extends from the outer diameter 208 to the inner diameter 206. The full-length baffle 220 may provide thermal control by controlling the airflow 210 within the airfoil 202. This may result in high Mach numbers and heat transfer coefficients across the entire airfoil 202, extending from the inner diameter 206 to the outer diameter 208. Because the baffle 220 extends the full length of the airfoil 202, the cooling may be too high or efficient at certain locations within the airfoil 202. This may result in unnecessary pressure loss and heat-up of the airflow 210 that may make it more difficult to cool other portions of the airfoil 202. Accordingly, the end result is a non-uniform temperature within the airfoil 202. Although shown with the baffle being open at both the top and the bottom (FIG. 2B), the outer diameter portion of the baffle and/or the inner diameter portion of the baffle may be capped or sealed, rather than open as shown in FIG. 2B.

Figure 3B:
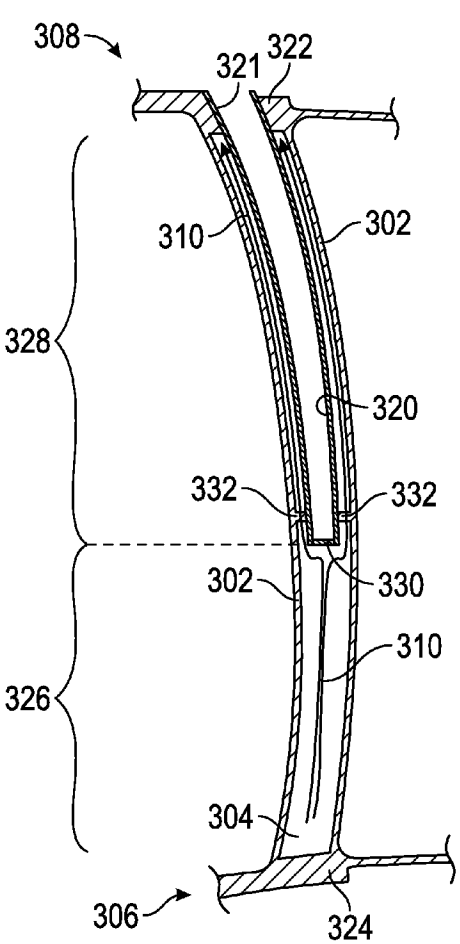
FIG. 3B is a cross-sectional view of the baffle along the line B-B of FIG. 3A.
Figure 3A:
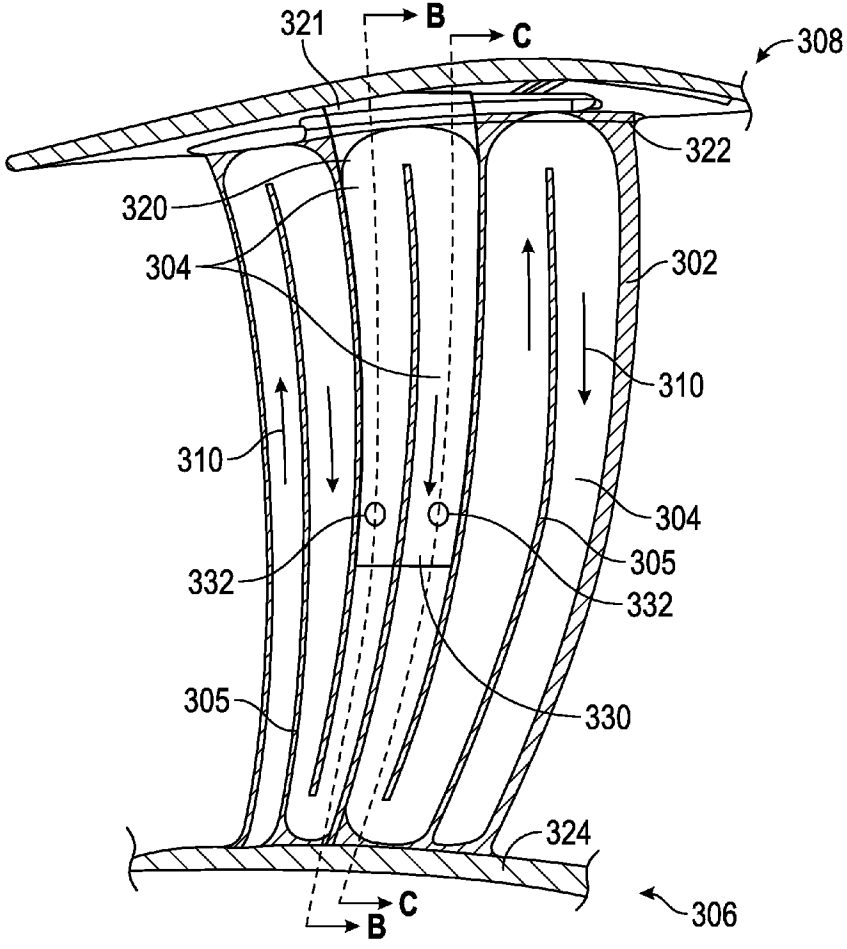
FIG. 3A is an isometric view of a baffle configuration in accordance with an example configuration in accordance with the present disclosure.
Figure 3C:
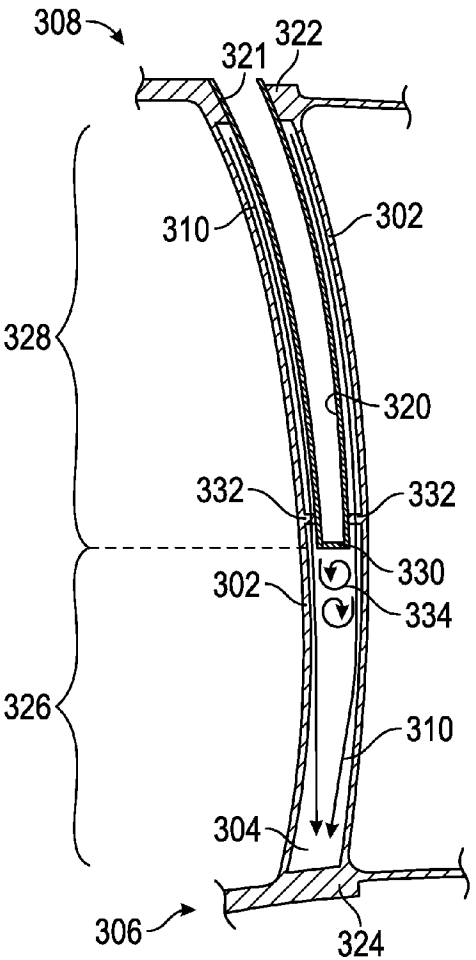
FIG. 3C is a cross-sectional view of the baffle along the line C-C of FIG. 3A.

Turning now to FIGS. 3A-3C, a baffle configuration in accordance with the present disclosure is shown. FIG. 3A is an isometric view of a baffle configuration in accordance with an example configuration in accordance with the present disclosure. FIG. 3B is a cross-sectional view of the baffle within the third airfoil cavity along the line B-B of FIG. 3A. FIG. 3C is a cross-sectional view of the baffle within the fourth airfoil cavity along the line C-C of FIG. 3A.

As shown, the configuration in FIGS. 3A-3C is similar to the configuration shown in FIGS. 2A-2B, although the baffle 320 is altered. An airfoil 302 extends from an inner casting 324 at an inner diameter 306 to an outer casting 322 at an outer diameter 308. The airfoil 302 is a hollow body defining a number of airfoil cavities 304 separated by partitions 305, with each airfoil cavity 304 fluidly connected to the other airfoil cavities 304. A baffle 320 is positioned within the airfoil 302 and is configured to control and/or alter the airflow 310 that passes through the airfoil cavities 304 of the airfoil 302.

As shown, the baffle 320 abuts against the outer casting 322 at the outer diameter 308 at a base 321. The baffle 320 extends inward from the base 321 toward the inner diameter 306 but does not extend the full length of the airfoil 302. That is, baffle 320 is a partial baffle that is shorter in comparison to full-baffles (e.g., compare with FIGS. 2A-2B). As such, the baffle 320 may divide an airfoil cavity 304 into two portions with different cross-sectional areas. A first portion 326 may be an open cavity having a first cross-sectional area and a second portion 328 may include the baffle and have a second cross-sectional. The first portion 326 may be considered an open cavity having a full cross-sectional area for the airflow 310. However, in the second portion 328 the baffle may reduce the cross-sectional area available for the airflow 310, and thus the second portion 328 may be a reduced cross-sectional area portion.

The baffle 320 may stop before extending the full length of the airfoil 302 and may end in a baffle end 330 that is located between the inner diameter 306 and the outer diameter 308. Because the baffle 320 is a partial baffle, it is unable to be secured at both the inner diameter 306 and the outer diameter 308, but only at the base 321. As such, one or more standoffs 332 may be provided to secure and position the baffle 320 within the airfoil cavity 304. In various embodiments, the standoffs 332 may be attached to, connected to, or integrally formed with the airfoil 302. In alternative embodiments, the standoffs 332 may be formed with or attached to the baffle 320. In other embodiments still, the standoffs may be separate components from the airfoil 302 and/or the baffle 320. In additional to providing support, the standoffs 332 may be configured to assist in installation of the baffle 320 within the airfoil 302 and/or prevent distortion, bulging, and/or collapse of the airfoil 302.

Advantageously, the configuration of baffle 320 shown in FIGS. 3A-3C may reduce the heat up of the airfoil 302 by altering the airflow through the airfoil cavities 304. For example, where there is an open cavity (e.g., first portion 326) there may be lower Mach numbers, lower pressure loss, and lower heat transfer coefficients, and where the air is located in a smaller cross-sectional area (e.g., second portion 328) there may be higher Mach numbers, higher pressure loss, and higher heat transfer coefficients. This may result in a more uniform temperature distribution within the airfoil 302. As will be appreciated by those of skill in the art, the length of the baffle 320 may be configured to any desired length within the airfoil cavities 304 and/or located within specific airfoil cavities 304 to provide or generate a desired pressure and/or temperature profile within the airfoil 302.

As shown in FIGS. 3B and 3C, the baffle end 330 is configured with a blunt or flat end face. As the airflow 310 passes through the airfoil cavities 304, the flow will be directed around the blunt baffled end 330. Thus, although the temperature profile of the airfoil 302 may be more uniform than a full-baffle configuration (e.g., full length baffle shown in FIGS. 2A, 2B), pressure losses may not be fully compensated for. For example, as shown in FIG. 3C, vortices 334 may form within the airflow 310 within the first portion 326 when the air is flowing from the second portion 328 into the first portion 326. That is, the airflow 310 may expand as the air enters the first portion 326 around the baffle end 330 causing turbulence and potentially high pressure loss at the baffle end 330.

As will be appreciated by those of skill in the art, the partial baffle may have other configurations without departing from the scope of the present disclosure. For example, in accordance with some non-limiting embodiments, the baffle may extend from a lower end of the cavity. In other non-limiting embodiments, the partial baffle may be located in the center of the cavity, such that the baffle has two ends and is not connected to either of the inner or outer casting, and thus may not include a base as described above.

Figure 4A:
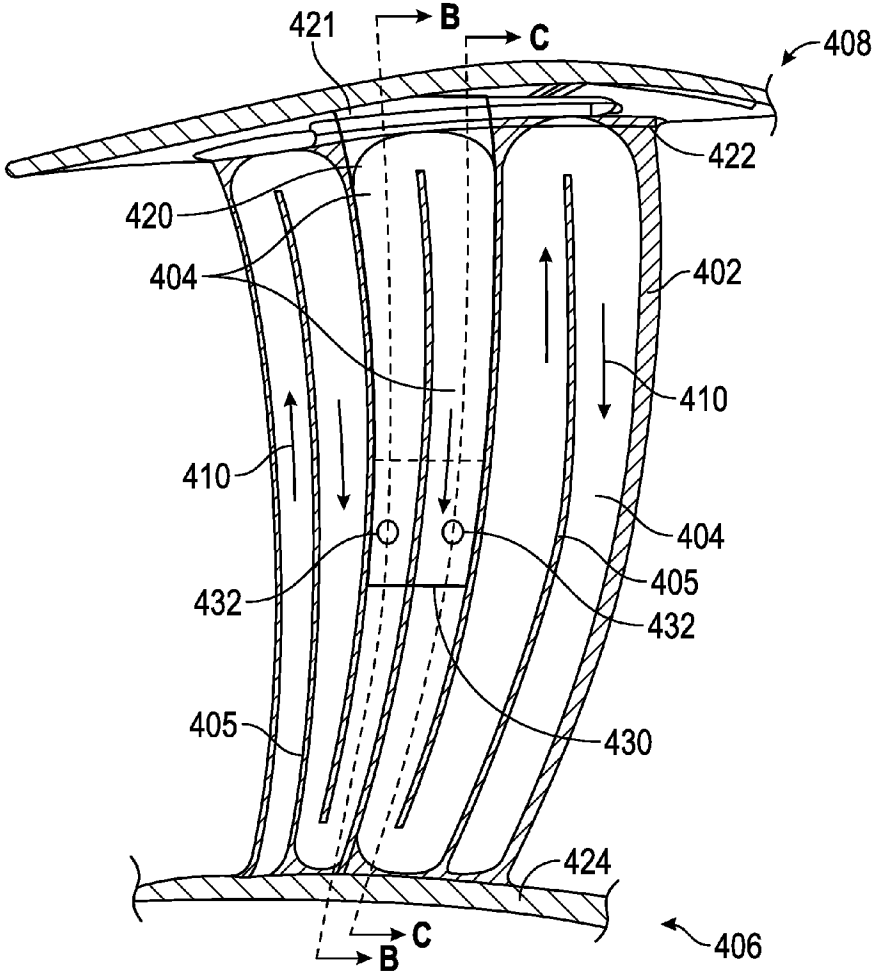
FIG. 4A is an isometric view of an alternative baffle configuration in accordance with an example configuration in accordance with the present disclosure.
Figure 4D:
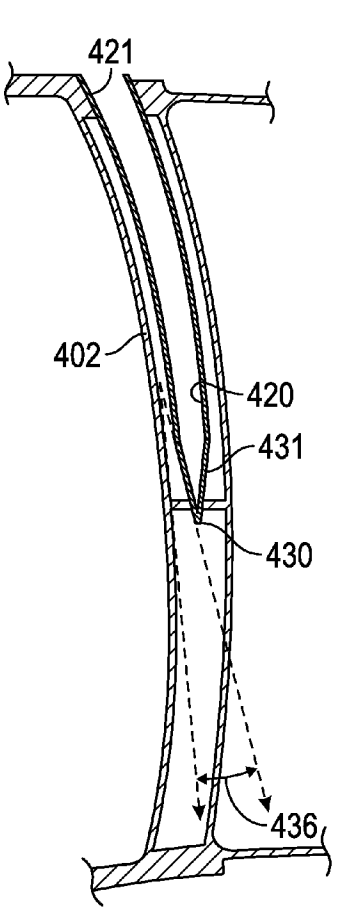
FIG. 4D is a cross-sectional view of the baffle along the line C-C of FIG. 4A.
Figure 4C:
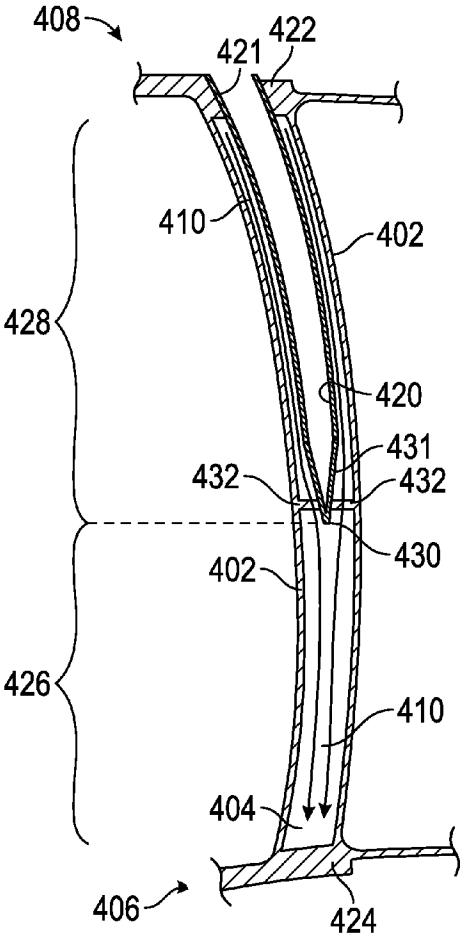
FIG. 4C is a cross-sectional view of the baffle along the line C-C of FIG. 4A.
Figure 4B:
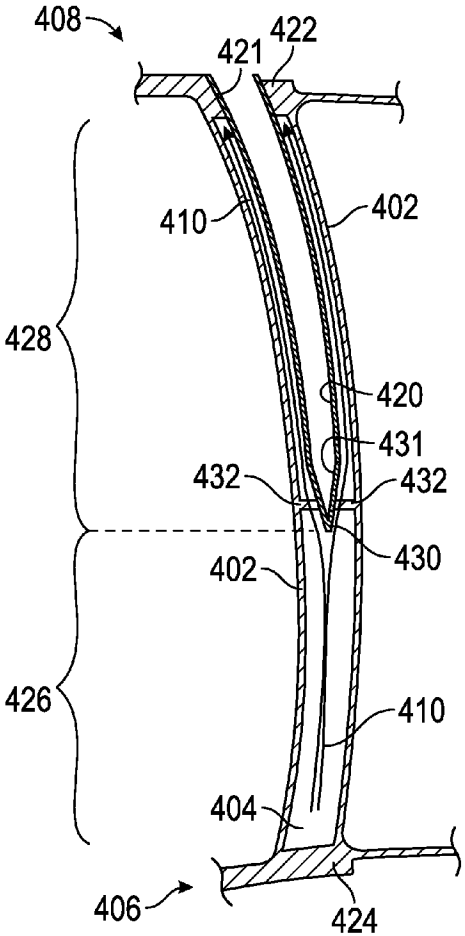
FIG. 4B is a cross-sectional view of the baffle along the line B-B of FIG. 4A.

For example, turning now to FIGS. 4A-4D, an alternative baffle configuration in accordance with the present disclosure is shown. FIG. 4A is an isometric view of a baffle configuration in accordance with an example of the present disclosure. FIG. 4B is a cross-sectional view of the baffle in the third cavity along the line B-B of FIG. 4A. FIGS. 4C and 4D are cross-sectional views of the baffle in the fourth cavity along the line C-C of FIG. 4A.

As shown, the configuration of FIGS. 4A-4D is similar to the configuration shown in FIGS. 3A-3C, although the baffle 420 is altered, particularly at the baffle end 430. That is, an airfoil 402 extends from an inner casting 424 at an inner diameter 406 to an outer casting 422 at an outer diameter 408. The baffle 420 is positioned within an internal cavity of the airfoil 402 and is configured to control and/or alter the airflow 410 that passes through the airfoil cavities 404 of the airfoil 402. The airfoil cavities 404 are separated by partitions 405, and the baffle extends into the cavities 404 from the base 421.

Similar to the embodiment of FIGS. 3A-3C, the baffle 420 is a partial baffle with a baffle end 430, and the baffle 420 is secured within the airfoil cavities 404 by one or more standoffs 432. Further, a first portion 426 is formed within the airfoil 402 toward the inner diameter 406 and a second portion 428, with a reduced cross-sectional area, is formed toward the outer diameter 408.

The primary difference between the baffle 420 of FIGS. 4A-4D and the baffle 320 of FIGS. 3A-3C is the baffle end configuration. As noted above, the baffle end 330 of baffle 320 is blunt or flat. However, in FIGS. 4A-4D, the baffle end 430 is tapered or formed as a wedge 431. In this configuration the tapered baffle end 430 gradually diverts the flow when the airflow 410 contacts the baffle 420 (FIG. 4B), and thus may result in low pressure losses. Further, when the airflow 410 is flowing in the opposite direction, the tapered configured of the baffle end 430 allows for the flow to gradually diffuse when the airflow 410 leaves the reduced cross-sectional area second portion 428, also resulting in low pressure loss in the airflow 410. Thus, the configuration in FIGS. 4A-4D provides both a reduction in heat up, similar to that provided by the configuration of FIGS. 3A-3C, and also provides for reduced pressure loss, and thus a more equalized thermal profile of the airfoil 402.

The tapered baffle end, in accordance with various embodiments, may have different or varying configurations. For example, in some embodiments, the angle of the wedge or tapered portion may be less than 45°. Further, in some embodiments, the angle of the wedge or tapered portion may be between 20° and 35°. As used herein, the angle referred to is the angle between the baffle surface at the tapered portion and the airfoil surface, as indicated by the angle 436 in FIG. 4D. Those of skill in the art will appreciate that the angle of the tapered portion at the baffle end may be any desired angle. The disclosure is not limited to the angles and/or ranges provided herein and the described angles and ranges are provided as examples.

Figure 5B:
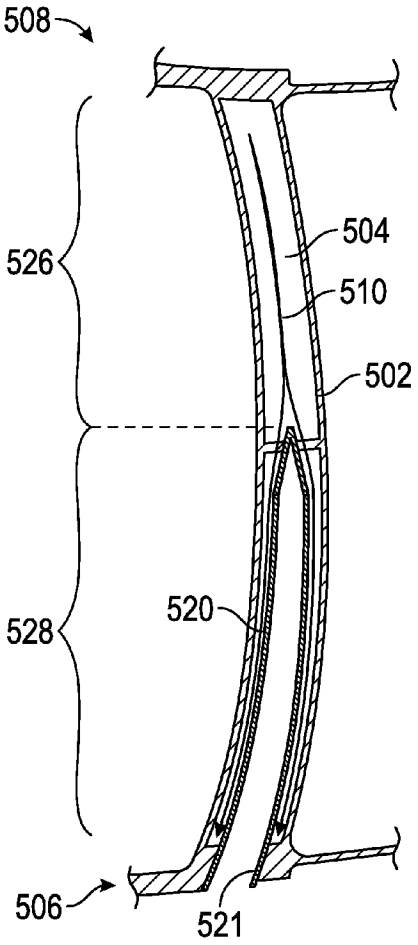
FIG. 5B is an alternative cross-sectional view of the baffle configuration of FIG. 5A.
Figure 5A:
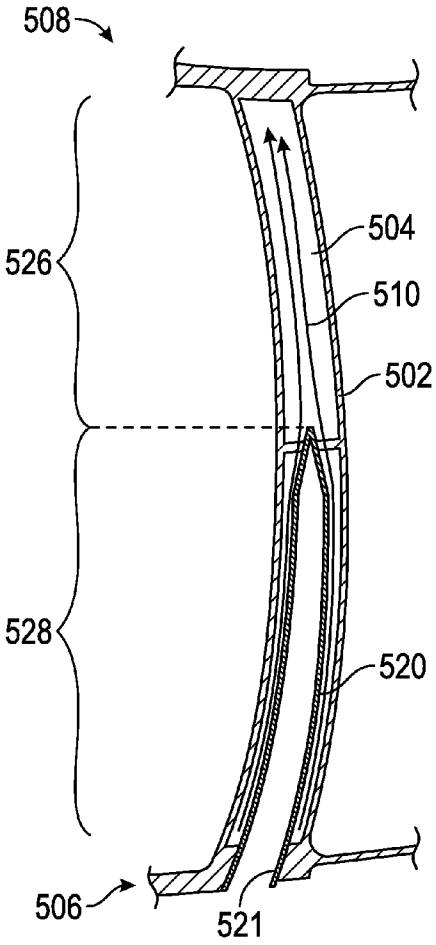
FIG. 5A is a cross-sectional view of an alternative configuration of a baffle in accordance with the present disclosure.

Turning now to FIGS. 5A and 5B, an alternative configuration of a baffle in accordance with the present disclosure is shown. FIG. 5A shows a cross-sectional view of a cavity 504 of an airfoil 502 having a baffle 520 configured therein, and FIG. 5B shows a cross-sectional view of an adjacent cavity 504 of the airfoil 502 with the baffle 520 configured therein, both showing the airflow 510 as it passes through the cavities 504. The configuration of FIGS. 5A and 5B may be substantially similar to the configurations described above, and thus various features will not be described again.

The primary difference between the configuration of FIGS. 5A-5B and FIGS. 4A-4D is the direction the baffle 520 extends into the cavities 504. As shown, the base 521 is at the inner diameter 506 and the baffle 520 extends from the inner diameter 506 toward the outer diameter 508. Thus, in this embodiment, the first portion 526 is closer to the outer diameter 508 and the reduced cross-sectional area second portion 528 is closer to the inner diameter 506. The first portion 526 may have low Mach numbers, low pressure loss, and low heat transfer, and the second portion 528 may have high Mach numbers, high pressure loss, and high heat transfer. Such configuration may be provided to enable a specific and/or desired thermal profile in the airfoil 502.

Figure 7:
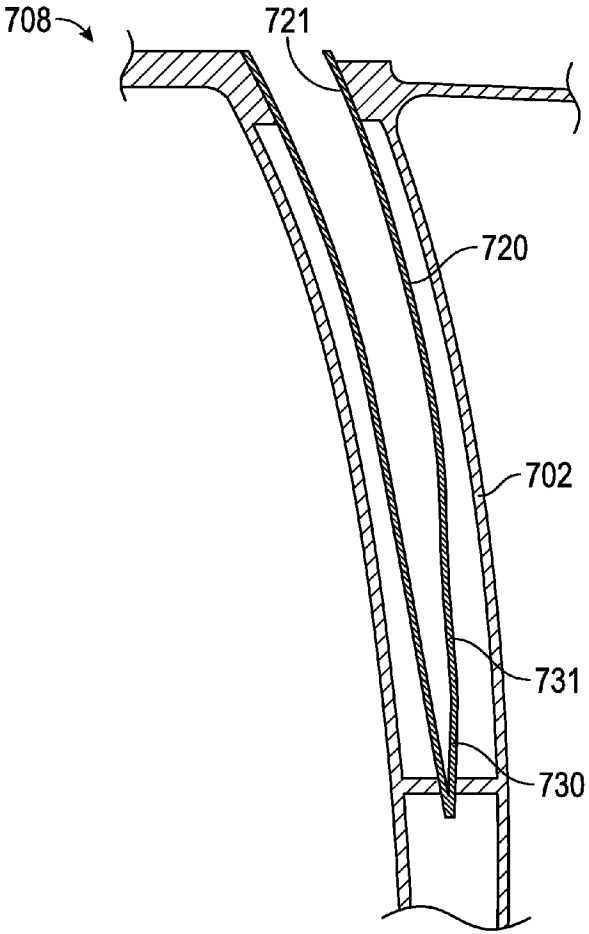
FIG. 7 is a cross-sectional view of an alternative configuration of a baffle in accordance with the present disclosure.
Figure 6:
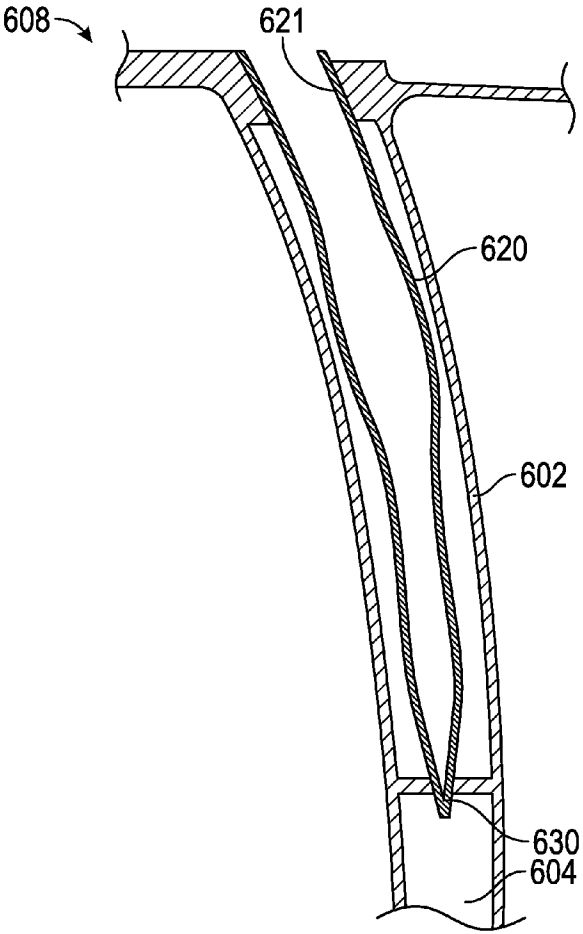
FIG. 6 is a cross-sectional view of an alternative configuration of a baffle in accordance with the present disclosure.

Turning now to FIGS. 6 and 7, alternative configurations or modifications of baffles in accordance with the present disclosure are shown.

In FIG. 6, the baffle 620 extends from the base 621 at the outer diameter 608 and may otherwise be similar to the configuration shown in FIGS. 4A-4D. However, in the embodiment shown in FIG. 6, the baffle 620 may have varying thickness between the outer diameter 608 and the baffle end 630. Thus, the airfoil cavity 604 may have a varying cross-sectional area along the baffle 620 from the outer diameter 608 to the baffle end 630. At the points where the baffle 620 is thicker higher Mach numbers, higher pressure loss, and higher heat transfer coefficients are generated. As such, the baffle 620 may be configured to generate or enable a desired thermal and/or pressure profile along the airfoil 602 by varying the thickness of the baffle 620 along its length.

In FIG. 7, the baffle 720 extends from the base 721 and has an extended tapering or wedge 731 as compared to prior discussed embodiments. The length of the tapering or wedge 731 of the baffle 720 may be configured to generate a desired pressure and/or thermal profile of the airfoil 702. In some embodiments, the tapering or wedge may extend the entire length of the baffle, such that the thickness of the baffle continuously reduces as it extends from a base of the baffle, i.e., where the baffle connects at the inner or outer diameter depending on the configuration.

Although various embodiments have been shown and described herein regarding a partial baffle, those of skill in the art will appreciate that various combinations of the above embodiments, and/or variations thereon, may be made without departing from the scope of the invention. For example, a single airfoil may be configured with more than one baffle, with at least one extending from the inner diameter and at least one extending from the outer diameter. Further, the lengths of the baffles within the cavities may be varied depending on the needs and designs of the airfoil and the particular application. Moreover, a baffle may have an extended tapered portion and a thicker portion (e.g., combining the embodiments of FIGS. 6 and 7). Additionally, the standoffs may be configured to accommodate the various configurations, with standoffs at the baffled ends and also, as needed, positioned along the length of the baffle. Further, if a baffle is not connected at either end, the baffle may be held in place by one or more standoffs and have a tapered end at both ends, i.e., tapered portions point toward the inner and outer castings. Moreover, by employing additive manufacturing techniques, a partial baffle with one or more features described herein, may be formed integrally within the cavity and not be connected at the ends, allowing for a specific air flow and pressure and temperature control, as desired.

It will be appreciated by those of skill in the art that the baffles disclosed and described herein may be separate components from the airfoils. In such configurations, the baffles may be inserted into the cavities and then welded or otherwise secured in place. However, in other embodiments, the baffles may be manufactured integrally with the airfoils, e.g., by additive manufacturing. Further, regardless of manufacturing technique, the baffle geometry (e.g., length, thickness, tapering, tapering angle, standoff positions, etc.) may be varied to generate a desired heat transfer, pressure loss, and/or Mach number, at any desired location within a cavity.

Advantageously, embodiments described herein provide increased uniformity in airfoils of turbines. For example, partial baffles may be configured to extend into a cavity of the turbine to increase Mach numbers, pressure losses, and/or heat transfer coefficients. Further, because the baffles are partial baffles, advantageously, the effects of the baffle may be stopped at a desired position within a cavity to further increase the uniformity of the thermal profile of an airfoil.

Further, advantageously, in accordance with some embodiments, a tapered baffle end may be provided to gradually divert a cooling flow around the outside of the baffle thus minimizing pressure loss. Additionally, a tapered baffle end may eliminate turbulence and/or vortices that may form in an airflow that flows about a partial baffle that is contained in a cavity of a turbine.

Advantageously, various embodiments described herein may provide minimal pressure loss and heat pickup in a turbine because the baffle may be configured and positioned only where it is needed within the cavity. That is, the baffles may be configured where it is needed to provide high heat transfer while allowing cooler regions of the cavity to have low heat transfer and pressure drops.

Further, advantageously, baffles provided herein may have varying geometries, lengths, thicknesses, tapered portions, etc. such that the baffles of the present disclosure may be configured or designed for the particular needs of a particular turbine configuration and/or thermal/pressure profile.

Moreover, advantageously, because the baffles are partial baffles, the amount of material required to make the baffles is reduced. Accordingly, there may be reductions in weight as compared to full-baffle configurations.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, as noted herein, features of baffles in accordance with the present disclosure may be combined and/or exchanged between embodiments such that a desired thermal equity may be achieved within a turbine. That is, the geometry, thickness, tapering, direction, etc. of baffles may be varied as desired to achieve a desired or needed thermal profile and distribution within an airflow in a turbine. Further, although various embodiments herein show the baffles covering certain cavities of an airfoil, the positioning is not limited thereto, and those of skill in the art will appreciate that the baffles may be configured to cover any desired cavities of an airfoil.

Accordingly, the present disclosure is not to be seen as limited by the foregoing description, but is only limited by the scope of the appended claims.

What is claimed is:

1. An airfoil of a gas turbine engine comprising:

a hollow body defining at least one airfoil cavity therein, the hollow body defining an inner diameter and an outer diameter;

a baffle positioned within the at least one airfoil cavity and extending over less than an entire length between the inner diameter and the outer diameter, the baffle configured to reduce a cross-sectional area within the at least one airfoil cavity such that the cross-sectional area available for the airflow through the airfoil cavity is reduced and no airflow passes through an interior of the baffle, wherein the at least one airfoil cavity includes a first portion having a length that is defined by an open cavity having a full cross-sectional area and a second portion having a length that is defined by a reduced cross-sectional area, the second portion being the length of the baffle within the at least one airfoil cavity, and at least one standoff in the second portion, the standoff configured to at least one of position the baffle and support the hollow body, wherein the baffle includes a tapered portion extending from a point on the baffle to a baffle end and wherein the at least one standoff is positioned to engage with the tapered portion.

2. The airfoil of claim 1, wherein the baffle extends from a base at one of the inner diameter and the outer diameter to a baffle end that is at a position that is between the inner diameter and the outer diameter.

3. The airfoil of claim 1, wherein the baffle comprises a tapered portion extending from a point on the baffle to a baffle end.

4. The airfoil of claim 3, wherein an angle between the tapered portion and a wall of the hollow body is less than 45°.

5. The airfoil of claim 3, wherein an angle between the tapered portion and a wall of the hollow body is between 20° and 35°.

6. The airfoil of claim 1, wherein the baffle has a varying thickness along the length of the second portion.

7. A method of manufacturing an airfoil, the method comprising:

forming a hollow body having at least one airfoil cavity therein, the hollow body extending from an inner diameter to an outer diameter;

installing a baffle within the at least one airfoil cavity such that the baffle extends over less than an entire length between the inner diameter and the outer diameter, the baffle configured to reduce a cross-sectional area within the at least one airfoil cavity such that the cross-sectional area available for the airflow through the airfoil cavity is reduced and no airflow passes through an interior of the baffle, wherein the at least one airfoil cavity has a first portion having a length that is defined by an open cavity having a full cross-sectional area and a second portion having a length that is defined by a reduced cross-sectional area, the second portion being the length of the baffle within the at least one airfoil cavity, and installing at least one standoff in the second portion, the standoff configured to at least one of position the baffle during installation and support the hollow body, wherein the baffle includes a tapered portion extending from a point on the baffle to a baffle end and wherein the at least one standoff is positioned to engage with the tapered portion.

8. The method of claim 7, wherein the at least one standoff is integrally formed with the hollow body.

9. The method of claim 7, wherein the baffle extends from a base at one of the inner diameter and the outer diameter to a baffle end that is at a position that is between the inner diameter and the outer diameter.

10. The method of claim 7, wherein the baffle comprises a tapered portion extending from a point on the baffle to a baffle end.

11. The method of claim 10, wherein an angle between the tapered portion and a wall of the hollow body is less than 45°.

12. The method of claim 10, wherein an angle between the tapered portion and a wall of the hollow body is between 20° and 35°.

13. The method of claim 7, wherein the baffle has a varying thickness along the length of the second portion.

14. The method of claim 7, wherein installing the baffle comprises integrally forming the baffle with the hollow body.

15. A gas turbine engine comprising:

an airfoil comprising:

a hollow body defining at least one airfoil cavity therein, the hollow body defining an inner diameter and an outer diameter; and a baffle positioned within the at least one airfoil cavity and extending over less than an entire length between the inner diameter and the outer diameter, the baffle configured to reduce a cross-sectional area within the at least one airfoil cavity such that the cross-sectional area available for the airflow through the airfoil cavity is reduced and no airflow passes through an interior of the baffle, wherein the at least one airfoil cavity has a first portion that is defined by an open cavity having a full cross-sectional area and a second portion that is defined by a reduced cross-sectional area, the second portion being the length of the baffle within the at least one airfoil cavity, and at least one standoff in the second portion, the standoff configured to at least one of position the baffle and support the hollow body, wherein the baffle comprises a tapered portion extending from a point on the baffle to the baffle end and wherein the at least one standoff is positioned to engage with the tapered portion.

16. The gas turbine engine of claim 15, wherein the baffle extends from a base at one of the inner diameter and the outer diameter to a baffle end that is at a position that is between the inner diameter and the outer diameter.

17. The gas turbine engine of claim 15, wherein the baffle has a varying thickness between the base and the baffle end.

* * * * *